United States Patent [19]

Hopfensperger

[11] Patent Number: 4,494,908

[45] Date of Patent: Jan. 22, 1985

[54] TANGENTIAL BLOWER

[75] Inventor: Reinhold Hopfensperger, Dietelskirchen, Fed. Rep. of Germany

[73] Assignee: International Standard Electric Corporation, New York, N.Y.

[21] Appl. No.: 468,244

[22] Filed: Feb. 22, 1983

Related U.S. Application Data

[63] Continuation of Ser. No. 257,819, Apr. 27, 1981, abandoned.

[30] Foreign Application Priority Data

Apr. 29, 1980 [DE] Fed. Rep. of Germany ..... 3016438

[51] Int. Cl.[3] ..... F04D 17/04

[52] U.S. Cl. ..... 415/206; 415/204; 415/207; 415/211; 415/219 R; 415/219 A; 415/219 B; 415/219 C

[58] Field of Search ..... 415/206, 207, 204, 219 B, 415/203, 205, 211, 219 C, 116, 181, 199.1, 219 A, 201, 213 B, 219 R

[56] References Cited

U.S. PATENT DOCUMENTS

| | | | |
|---|---|---|---|
| 132,829 | 11/1872 | Harris | 415/203 |
| 1,914,919 | 10/1931 | Heermans | 415/219 B |
| 3,141,607 | 4/1963 | Masters | 415/54 |
| 3,288,355 | 11/1966 | Laing | 415/145 |
| 3,305,665 | 2/1967 | Laing | 415/204 |
| 3,692,426 | 9/1972 | Ryall et al. | 415/219 B |
| 4,078,870 | 3/1978 | Keller et al. | 415/54 |

FOREIGN PATENT DOCUMENTS

| | | | |
|---|---|---|---|
| 1428190 | 11/1968 | Fed. Rep. of Germany | 415/207 |
| 1951115 | 4/1971 | Fed. Rep. of Germany . | |
| 1066598 | 4/1967 | United Kingdom . | |

*Primary Examiner*—Randall L. Green
*Assistant Examiner*—Brian J. Bowman
*Attorney, Agent, or Firm*—T. L. Peterson

[57] ABSTRACT

Owing to a new design of the partition wall (vortex former) of the novel type tangential blower, there is achieved an improvement of the pressure-volume characteristic and a reduction of the noise development.

8 Claims, 8 Drawing Figures

TANGENTIAL BLOWER

This is a continuation of application Ser. No. 257,819 filed Apr. 27, 1981, now abandoned.

BACKGROUND OF THE INVENTION

The invention relates to a tangential blower consisting of a conducting element mounted to the side members of the housing and enclosing the pressure space, of a partition wall between the suction and the pressure space, and of an impeller rotatably supported in bearings provided for in the side members of the housing, with the impeller having blade edges extending almost in parallel with the axis of rotation.

One such type of tangential blower is known (DE-AS No. 25 45 036). With this conventional type of tangential blower, there was supposed to be provided a blower which, by neglecting the exclusive pressure gain, operates by producing substantially less noise than the conventional blowers of comparable types.

For this purpose, this conventional type of tangential blower is provided with an expensively designed partition wall having additional conducting walls and porous walls. Such costly measures cause a product to become considerably more expensive and, therefore, are unsuitable for large-scale production; moreover, it is doubtful whether this conventional type of tangential blower is capable of maintaining its noise-reducing properties in the long run, as it is very likely that this advantage is lost by soiling and, consequently, owing to the pores becoming clogged after some time.

Moreover, some tangential blowers are known (German Pat. No. 14 28 071) which have a stable and low-noise run. With this conventional type of tangential blower, owing to a spiral-shaped design of the conducting element and with the latter having a correspondingly large surrounding angle, there is achieved a stable airflow characteristic, and this blower also only produces relatively little noise.

This conventional type of tangential blower which, for more than ten years, has up to now been produced in very large quantities, and continues to be produced, has in the past been able to meet all requirements regarding airflow and noise development.

In the course of the efforts which have been made with a view to improving the environmental conditions, and owing to the necessity of providing an improved economy, especially in terms of energy consumption, the applicance-manufacturing industry demands in future tangential blowers which, on the one hand, have an improved airflow characteristic compared with conventional types of tangential blowers, thus permitting a compact construction of the appliances and which, on the other hand, must also be extremely noiseless during operation.

At the present time, these requirements, especially with a view to a low noise development, are not met by any of the conventional types of tangential blowers. The small success which has up to now been achieved in reducing the noise radiation of a tangential blower, shows that up to now it was only possible to realize a tangential blower having a reduced noise radiation, by involving a considerable investment. The manufacture of large quantities, however, requires the tangential blower to have a simple construction.

It is the object of the invention, therefore, to provide a tangential blower whose external dimensions do not exceed the external dimensions of the conventional type of tangential blower which is being manufactured in large quantities, which operates with an extremely low noise, which provides an improved airflow, and which has a simple construction meeting large-scale production requirements. It is taken for granted that the blower should have a stable operating behaviour.

SUMMARY OF THE INVENTION

According to the invention, this object is achieved in that the air-conducting element—starting from a line of the greatest approximation to the circumference of the impeller—extends at first at a preferably continuously increasing distance from the circumference of the impeller and, after ninety or more angular degrees, continues to extend substantially as a straight line, that the partition wall is designed in such a way that its end facing the impeller, forms a rounding, that its end not facing the impeller, together with the substantially straight portion of the air-conducting element, forms an angle ($\alpha$) of between 20 and 40 degrees, and that this end assumes such a position that the pressure-sided outlet cross section amounts approximately from 55–65% of the inlet cross section on the suction side.

These measures, when applied to the novel tangential blower, compared with the tangential blower as known from the German Pat. No. 14 28 071, result in a higher airflow output and in a lower noise development by maintaining the same impeller speed.

DESCRIPTION OF THE PREFERRED EMBODIMENT

Figure 1:
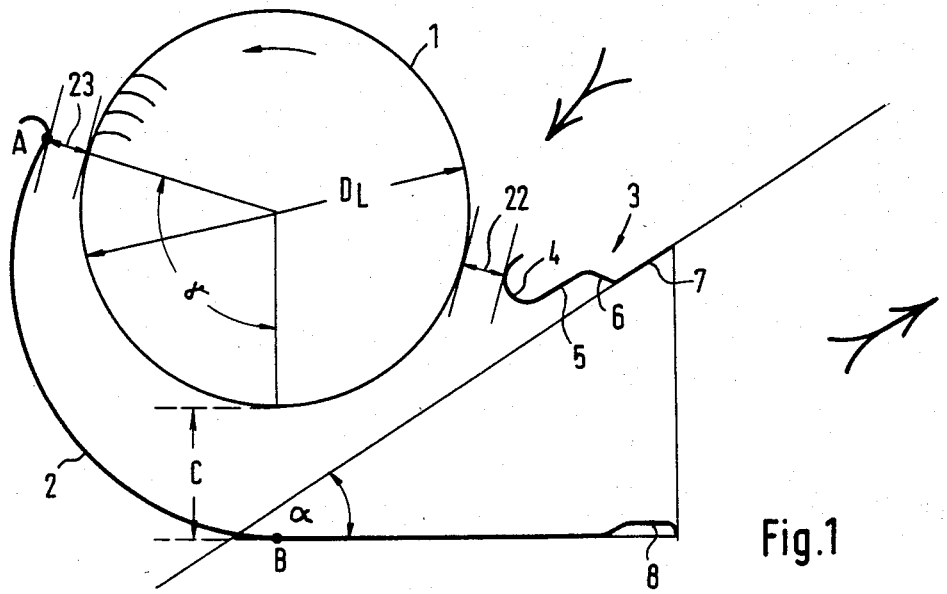
FIG. 1 shows the profile of the novel tangential blower.

FIG. 1 illustrates the profile of the novel tangential blower, consisting of the impeller 1, of the air-conducting element 2 and of the partition wall 3 between the suction and the pressure space. The conducting element 2, between the points A (smallest spacing between the conducting element and the impeller) and B over an angle $\gamma \geqq 90°$, takes a spiral-shaped course and then extends into a straight line. If the conducting element 2, within its spiral-shaped area, should happen to deviate slightly from the exact spiral, this will have no considerable effects upon the physical properties of the tangential blower. The same also applies to the straight portion of the conducting element. The size of the spacing C between the impeller 1 and the conducting element 2, however, is of considerable importance to the tangential blower according to the invention. The spacings between the impeller circumference and the rounding 4 or the conducting element 2 at A are indicated by the reference numerals 22 or 23 respectively. The impeller diameter is designated $D_L$ in the drawing.

The partition wall 3 is of step-design, with the end of the partiton wall lying nearest to the impeller, being designed as a rounding 4. The lower end of the rounding 4 extends further as a straight line 5 continuously moving apart from the straight-lined portion of the conducting element 2. In extension thereof, the partition wall has a straight section 6 which is inclined towards the straight portion of the conducting element 2. The last section 7 of the partition wall 3 is likewise straight and again takes a course moving continuously away from the straight portion of the conducting element 2, with it, together with the straight portion of the conducting element 2, forming the angle $\alpha=20$ to 40 degrees. In the given example of embodiment, the central, stepped portion of the partition wall 3 is designed in such a way that the change of direction within the area of the step is effected rather abruptly. The change of direction within the stepped area, however, may also take place more smoothly, so that this central area is of more undulated form. The pressure-sided end of the conducting element 2 is provided with the stepping 8 extending almost over the entire length of the blower. The stepping 8, for example, may extend over two thirds of the length of the blower, with it not existing within the area of the side members.

Figure 2:
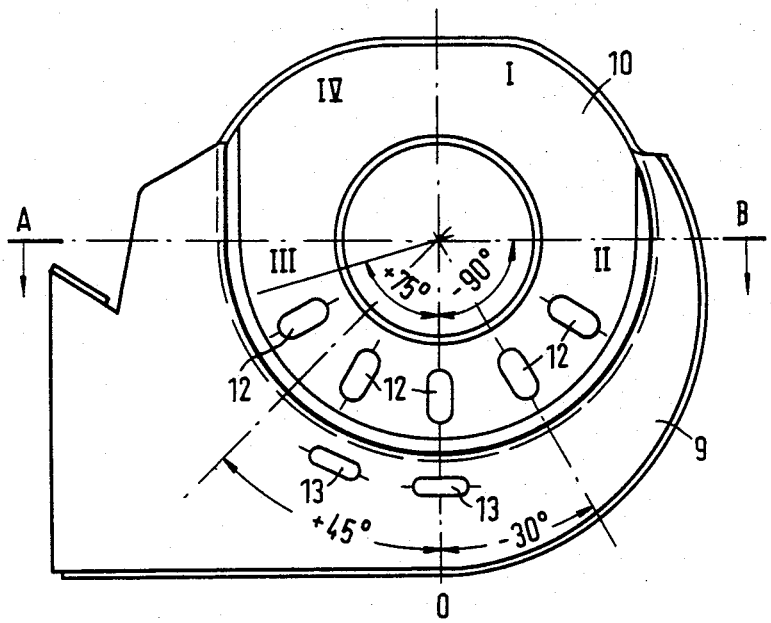
FIG. 2 is a top view onto one side member of the housing.
Figure 3:
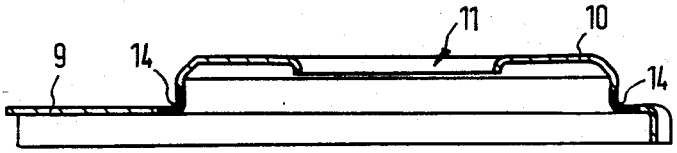
FIG. 3 is a sectional view of the side member of the housing taken on line A–B of FIG. 2.

FIG. 2 shows one side member 9 of the housing which, within the area in which the impeller is rotatably supported therein, is enlarged to form a pocket 10 (FIG. 3). The edge 14 at the transition between the pocket 10 and the side member 9 of the housing, is rounded. In the example of embodiment as shown in FIGS. 2 and 3, the side member 9 of the housing is provided within the area of the impeller bearing, with the bearing opening 11 in which, in the manner as known per se, the elastic impeller bearing is buttoned.

The side member 9 of the housing of the novel type of tangential blower, as shown in FIG. 2, is provided with further openings 12 and 13 which are provided for within the area of the pocket 10 as well as also outside thereof. In FIG. 2, the openings within the pocket 10 are indicated by the reference numeral 12, and the openings outside the pocket 10 are indicated by the reference numeral 13. In order to illustrate the position of the openings 12 and 13 more clearly, the pocket 10 in FIG. 2 is subdivided into the quadrants I to IV, and the vertical parting line between the quadrants has been chosen as the O-line. Thus, it is evident from FIG. 2 that the openings 12 extend from $-90°$ to $+75°$, id est over approximately 165°. The openings 13, however, extend from $-30°$ to $+45°$, id est over approximately 75°.

Figure 4:
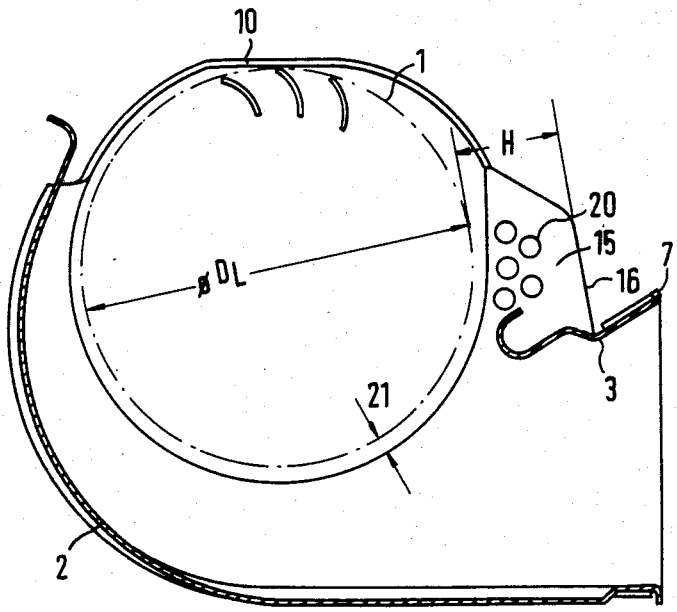
FIG. 4 is the cross sectional view of the novel tangential blower.

FIG. 4 shows two further special features of the novel type of tangential blower. This is firstly the conducting wall 15 which forms part of the side member 9 of the housing and lies above the partitior wall 3. Its slanting outer edge 16 has a minimum spacing from the impeller $H=0.2\times D_L$; this conducting wall 15 may be provided with openings 20. Secondly, when the impeller 1 is inserted, there will remain between the circumference thereof and the axially parallel interior surface of the pocket, a trap 21 which is supposed to amount from 0.015 to $0.05\times D_L$. In the case of an impeller diameter $D_L=65$ mm, the gap 21 has a size ranging between 1 and 3.5 mm.

Figure 5:
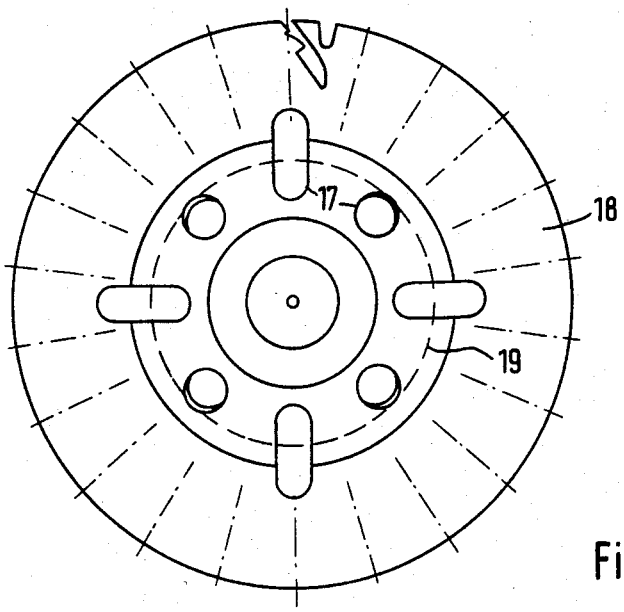
FIG. 5 is the top view onto one face side of the impeller.

FIG. 5 shows the arrangement and the distribution of the openings 17 in the face sides 18 of the impeller 1. As can be seen from FIG. 5, the majority of the opening cross section (approximately 60–70%) is lying within the circle 19 having a diameter $D\approx 0.5\times D_L$. The remaining 30–40% of the opening cross section is lying outside the circle 19, but within a circle having a diameter $D\approx 0.75\times D_L$.

Figure 6:
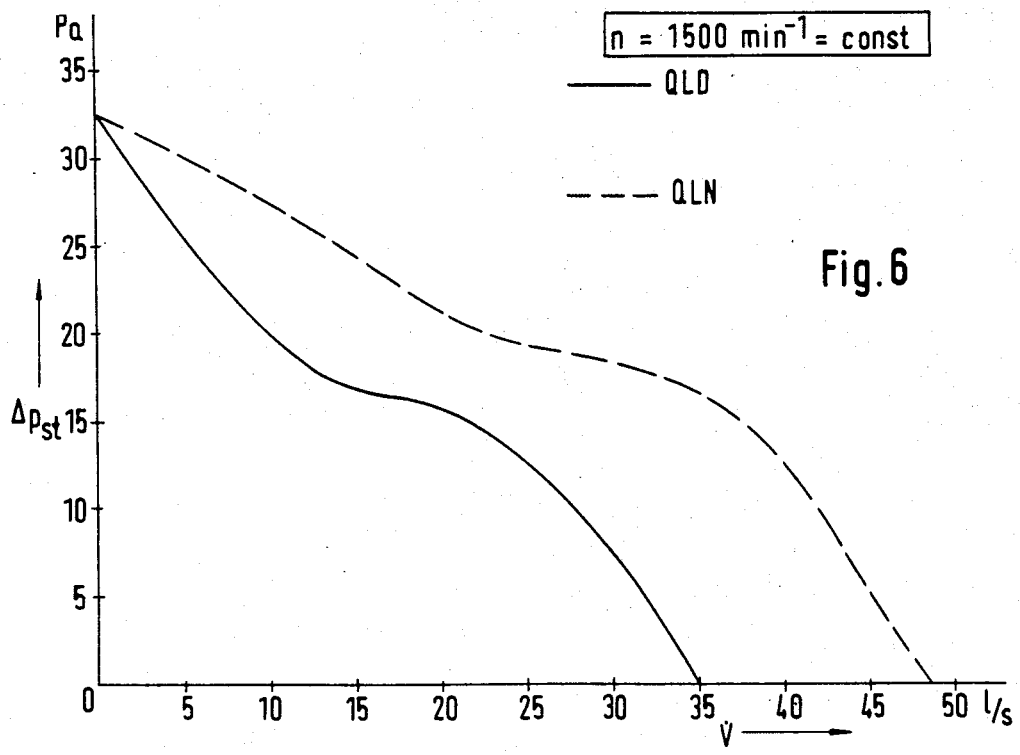
FIG. 6 is the pressure-volume characteristic of the novel tangential blower at a constant impeller speed as compared with the corresponding characteristic of the conventional blower.

FIG. 6 shows the pressure-volume characteristic of the novel type of tangential blower (QLN) as compared with the corresponding characteristic of the conventional type of tangential blower (QLD) as known from the German Pat. No. 14 28 071, taken at a constant speed of the impeller. FIG. 6 illustrates that the novel type of tangential blower, at the same impeller speed, approximately supplies the same maximum pressure, but a substantially greater amount of air.

Figure 7:
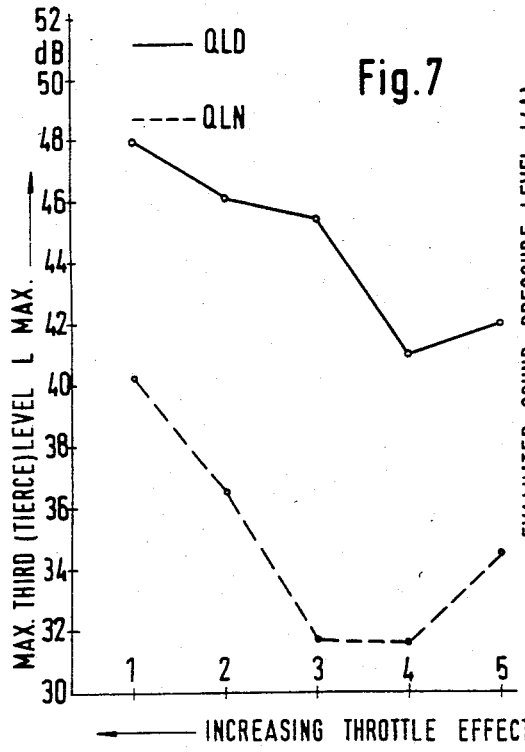
FIG. 7 shows the maximum third (tierce) level at various operating points relating to both the novel and the conventional tangential blower.
Figure 8:
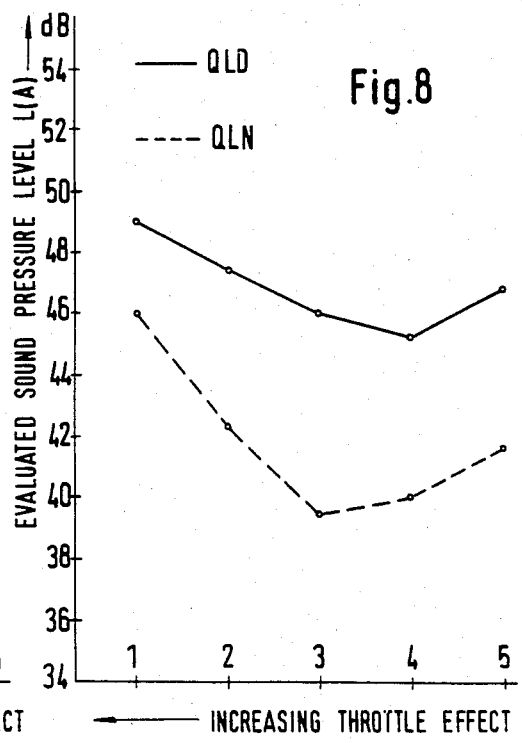
FIG. 8 shows the evaluated sound pressure level at various operating points relating to both the novel (QLN) and the conventional (QLD) tangential blower.

The FIGS. 7 and 8 illustrate the noise behaviour of the novel type of tangential blower as compared with that of the conventional type of tangential blower. The characteristics indicate a distinct reduction of the noise radiation.

I claim:

1. In a tangential blower having a conducting element mounted to the side members of the housing and enclosing the pressure space of the blower, a partition wall between the suction and the pressure spaces of the blower, and an impeller rotatably supported in bearings provided for in the side members of the housing, having blade edges extending almost in parallel with the axis of rotation, said conducting element—starting from a line of greatest approximation to the circumference of the impeller—extending at first at a preferably continuously increasing distance away from the circumference of the impeller and, after ninety or more angular degrees, continues to extend substantially as a straight line, the end of the partition wall facing the impeller having a rounding, the improvement comprising:

(a) said partition wall (3), starting out from said rounding (4), has a first section expanded in a diffuser-like manner, a second section constricted in a confuser-like manner and, finally, a third section expanded in a diffuser-like manner until reaching the outlet cross section, said third section of said partition wall (3) together with the straight portion of said conducting element including an angle ($\alpha$) between 20 and 40 degrees, and having such a position that the pressure-side outlet cross section will amount to approximately 55 to 65% of the intake cross section on the suction side;

(b) the pressure-sided outer edge of the conducting element (2) is provided with a stepping (8) extending over almost the entire length of the blower;

(c) the distance C (FIG. 1) between the impeller circumference and the conducting element (2) amounts to approximately 0.2 to $0.4\times D_L$ (impeller diameter);

(d) the side members (9) of the housing are provided with pockets (10) having openings (12), and the side members (9) of the housing are also provided with openings (13) outside the pocket range, said openings (12) within the pocket range being arranged within an angular section of approximately 165 degrees in quadrant II and in quadrant III of the side members (9) of the housing, and altogether having an opening cross section amounting approximately to 4–5% of the impeller face side;

(e) the impeller face sides are provided with openings (17); and (f) the spacing (23) between the impeller circumference and the conducting element (2) at the point (A) of its greatest approximation to the impeller, amounts approximately from 0.08 to $0.12 \times D_L$.

2. A tangential blower as claimed in claim 1 the side members (9) of the housing are provided above said partition wall (3) with conducting walls (15).

3. A tangential blower as claimed in claim 2 wherein the edge (16) of the conducting walls (15), not facing the impeller (1), is arranged at a minimum spacing (H) of $0.2 \times D_L$ from the impeller circumference.

4. A tangential blower as claimed in claim 1 wherein the spacing (21) between the impeller circumference and the axially parallel pocket inner surface amounts approximately from 0.015 to $0.05 \times D_L$.

5. A tangential blower as claimed in claim 1 wherein the spacing (22) between the impeller circumference and the rounding (4) of said partition wall (3) amounts approximately from 0.07 to $0.11 \times D_L$.

6. In a tangential blower having a conducting element mounted to the side members of the housing and enclosing the pressure space of the blower, a partition wall between the suction and the pressure spaces of the blower, and an impeller rotatably supported in bearings provided for in the side members of the housing, having blade edges extending almost in parallel with the axis of rotation, said conducting element—starting from a line of greatest approximation to the circumference of the impeller—extending at first at a preferably continuously increasing distance away from the circumference of the impeller and, after ninety or more angular degrees, continues to extend substantially as a straight line, the end of the partition wall facing the impeller having a rounding, the improvement comprising:

(a) said partition wall (3), starting out from said rounding (4), has a first section expanded in a diffuser-like manner, a second section constricted in a confuser-like manner and, finally, a third section expanded in a diffuser-like manner until reaching the outlet cross section, said third section of said partition wall (3) together with the straight portion of said conducting element including an angle ($\alpha$) between 20 and 40 degrees, and having such a position that the pressure-sided outlet cross section will amount to approximately 55 to 65% of the intake cross section on the suction side;

(b) the pressure-sided outer edge of the conducting element (2) is provided with a stepping (8) extending over almost the entire length of the blower;

(c) the distance C (FIG. 1) between the impeller circumference and the conducting element (2) amounts to approximately 0.2 to $0.4 \times D_L$ (impeller diameter);

(d) the side members (9) of the housing are provided with pockets (10) having openings (12), and the side members (9) of the housing are also provided with openings (13) outside the pocket range, said openings (13) outside the pocket range being arranged in a continuous angular section occupying approximately 30° in quadrant II and approximately 40° in quadrant III, and altogether having an opening cross section of approximately 3% of the impeller face side;

(e) the impeller face sides are provided with openings (17); and (f) the spacing (23) between the impeller circumference and the conducting element (2) at the point (A) of its greatest approximation to the impeller, amounts approximately from 0.08 to $0.12 \times D_L$.

7. In a tangential blower having a conducting element mounted to the side members of the housing and enclosing the pressure space of the blower, a partition wall between the suction and the pressure spaces of the blower, and an impeller rotatably supported in bearings provided for in the side members of the housing, having blade edges extending almost in parallel with the axis of rotation, said conducting element—starting from a line of greatest approximation to the circumference of the impeller—extending at first at a preferably continuously increasing distance away from the circumference of the impeller and, after ninety or more angular degrees, continues to extend substantially as a straight line, the end of the partition wall facing the impeller having a rounding, the improvement comprising:

(a) said partition wall (3), starting out from said rounding (4), has a first section expanded in a diffuser-like manner, a second section constricted in a confuser-like manner and, finally, a third section expanded in a diffuser-like manner until reaching the outlet cross section, said third section of said partition wall (3) together with the straight portion of said conducting element including an angle ($\alpha$) between 20 and 40 degrees, and having such a position that the pressure-sided outlet cross section will amount to approximately 55 to 65% of the intake cross section on the suction side;

(b) the pressure-sided outer edge of the conducting element (2) is provided with a stepping (8) extending over almost the entire length of the blower;

(c) the distance C (FIG. 1) between the impeller circumference and the conducting element (2) amounts to approximately 0.2 to $0.4 \times D_L$ (impeller diameter);

(d) the side members (9) of the housing are provided with pockets (10) having openings (12), and the side members (9) of the housing are also provided with openings (13) outside the pocket range;

(e) the impeller face sides are provided with openings (17), the opening cross section of said openings (17) in one impeller face side amounting to approximately 7.5% of this face side, with the majority of said opening cross-section of said openings (17) being arranged within, and with a smaller portion of said opening cross-section of said openings (17) being arranged outside, a circular area (19) having $D \approx 0.5 \times D_L$; and (f) the spacing (23) between the impeller circumference and the conducting element (2) at the point (A) of its greatest approximation to the impeller, amounts approximately from 0.08 to $0.12 \times D_L$.

8. In a tangential blower having a conducting element mounted to the side members of the housing and enclosing the pressure space of the blower, a partition wall between the suction and the pressure spaces of the blower, and an impeller rotatably supported in bearings provided for in the side members of the housing, having blade edges extending almost in parallel with the axis of rotation, said conducting element—starting from a line of greatest approximation to the circumference of the impeller—extending at first at a preferably continuously increasing distance away from the circumference of the impeller and, after ninety or more angular degrees, continues to extend substantially as a straight line, the end of the partition wall facing the impeller having a rounding, the improvement comprising:

(a) said partition wall (3), starting out from said rounding (4), has a first section expanded in a diffuser-like manner, a second section constricted in a confuser-like manner and, finally, a third section expanded in a diffuser-like manner until reaching the outlet cross section, said third section of said partition wall (3) together with the straight portion of said conducting element including an angle ($\alpha$) between 20 and 40 degrees, and having such a position that the pressure-side outlet cross section will amount to approximately 55 to 65% of the intake cross section on the suction side;

(b) the pressure-sided outer edge of the conducting element (2) is provided with a stepping (8) extending over almost the entire length of the blower;

(c) the distance C (FIG. 1) between the impeller circumference and the conducting element (2) amounts to approximately 0.2 to $0.4 \times D_L$ (impeller diameter);

(d) the side members (9) of the housing are provided with pockets (10) having openings (12), the side members (9) of the housing are also provided with openings (13) outside the pocket range, the side members (9) of the housing being provided above said partition wall (3) with conducting walls (15), said conducting walls being provided with openings (20);

(e) the impeller face sides are provided with openings (17); and (f) the spacing (23) between the impeller circumference and the conducting element (2) at the point (A) of its greatest approximation to the impeller, amounts approximately from 0.08 to $0.12 \times D_L$.

* * * * *